US006321474B1

(12) United States Patent
Pearson

(10) Patent No.: US 6,321,474 B1
(45) Date of Patent: Nov. 27, 2001

(54) SIGN APPARATUS

(76) Inventor: Chad Pearson, Rte. 5, Box 153, Honea Path, SC (US) 29654

( * ) Notice: Subject to any disclaimer, the term of this patent is extended or adjusted under 35 U.S.C. 154(b) by 0 days.

(21) Appl. No.: 09/315,402

(22) Filed: May 20, 1999

(51) Int. Cl.[7] ..... G09F 11/30
(52) U.S. Cl. ..... 40/509; 40/510
(58) Field of Search ..... 40/508, 509, 510

(56) References Cited

U.S. PATENT DOCUMENTS 963,336 * 7/1910 Tas ..... 40/510
1,059,784 * 4/1913 Tas ..... 40/510
3,201,883 * 8/1965 Schleisner-Meyer ..... 40/513
3,264,766 8/1966 Offsay ..... 40/36
3,313,055 4/1967 Irasek ..... 40/36
3,327,417 6/1967 Cox ..... 40/36
4,006,545 2/1977 Mathews ..... 40/36

* cited by examiner

*Primary Examiner*—Cassandra H. Davis
(74) *Attorney, Agent, or Firm*—John B. Hardaway, III; Hardaway/Mann IP Group

(57) ABSTRACT

A signage apparatus has a storage magazine of cartridges which may be individually displayed as desired.

8 Claims, 7 Drawing Sheets

SIGN APPARATUS

BACKGROUND OF THE INVENTION

1. Field of Invention

The present invention relates to a sign apparatus and more particularly to an illuminated sign apparatus that has at least two sides wherein multiple, individual signs are capable of being stored and are interchangeable when in use.

2. Description of Prior Art

Most of the prior art in this area are devices that have signs that cannot specifically be chosen when they are to be displayed. Instead, the signs are in a predetermined order, sometimes even in stacks or lines, and are displayed according to the order in which they appear. Such is the case with he patent for a "Display Device" issued to Mathews, U.S. Pat. No. 4,006,545, which is directed to a display for advertisement cards wherein a card is displayed for a period of time and then withdrawn and another card is displayed. A card is displayed and then picked up, lifted over the remaining cards and lowered back down at the back of the remaining cards, hence rotating the card to the end of the rotation. In this device, the cards are picked up by blocks, which are connected to chains, and carried through a rotation before being placed at the end of the remaining cards which are queued for viewing. This device does not have a gripper element that actually grips a sign and lifts it from its stored location and places it in an aperture for viewing and then replaces the sign back in the same storage location as it was previously stored in as in the present invention.

The Cox patent, U.S. Pat. No. 3,327,417, entitled "Automatic Viewer" is directed to an advertising media that automatically displays advertisements in a sequential relationship to one another. The Cox device is a display that elevates one of a stack of signs into a window and then removes it to the back of the stack of signs while simultaneously replacing the sign being viewed. The signs are elevated with a series of roller elements.

The patent issued to Irasek, U.S. Pat. No. 3,313,055, discloses a "Random Access Storage and Retrieval Device" wherein a plurality of items in holders such as film chips or visual slides can be stored and retrieved for viewing upon command. The items are retrieved by a picker bar which engages and grips the holder of the selected item and withdraws the holder from the stack. When returned to the stack, the holder is placed either on the top or the bottom of the stack, thus the holders ultimately end up in a random orientation to one another. The holders are identified by address bars.

The "Display Device" described in the patent issued to Offsay, U.S. Pat. No. 3,264,766, is for a display that houses a series of cards which can be displayed. The cards are stacked in the lower part of the display and a movable arm is lowered wherein it drops the card that was previously displayed onto the top of the pile, pushes the pile up so that the card on the bottom of the pile comes into contact with the movable arm, then the movable arm lifts the bottom card up to the display position. At the end of the duration of displaying the card, the entire process is repeated, thus lowering the displayed card to the top of the pile and raising the bottom card to the display position. In this display, always the bottom card is raised to the display position and replaced to the top of the pile when no longer displayed. Therefore, the cards are always displayed in the order they are located in the pile.

While the above stated devices are a fair representation of the current prior art, there remains room for improvement as defined by the currently claimed invention.

SUMMARY OF THE INVENTION

An objective of the present invention is to provide a sign apparatus that is capable of displaying numerous individual signs.

Another objective of the present invention is to develop a sign apparatus that can change individual signs numerous times and at desired intervals.

Still another objective is to have a sign apparatus that can display different individual signs concurrently.

Yet another objective of the present invention is to illuminate various individual signs in a visible manner.

And another objective of the present invention is to store numerous individual signs when not in use.

Another objective of the presently claimed sign apparatus is to automatically change numerous individual signs.

The aforementioned objectives will be accomplished as well as other features and advantages of the present invention will become more apparent from the following detailed description of a sign apparatus having a magazine of cartridges that can be stored and retrieved as desired. An individual sign is located within each cartridge. A controller signals and controls a retrieval means to locate the desired cartridges from within the magazine, retrieve the cartridges using a gripper means, raise the cartridge out of the magazine, move it adjacent or within an aperture in a side wall of the sign apparatus and illuminate the individual signs within the cartridges with an illumination means. The individual signs are moved about within the sign apparatus by a retrieval means having an upper winch, a lower winch, a power supply 160, an upper horizontal track for the upper winch to navigate, a lower horizontal track for the lower winch to navigate and a vertical track therebetween upon which the gripper means is located. The description of the present invention discloses, in conjunction with the drawings which illustrate by way of example, the principles and objects of the invention.

BRIEF DESCRIPTION OF THE DRAWINGS

The features of the present invention will become apparent to those skilled in the art to which the present invention relates from the following specification with reference to the accompanying drawings in which.

DETAILED DESCRIPTION OF THE INVENTION

Figure 1:
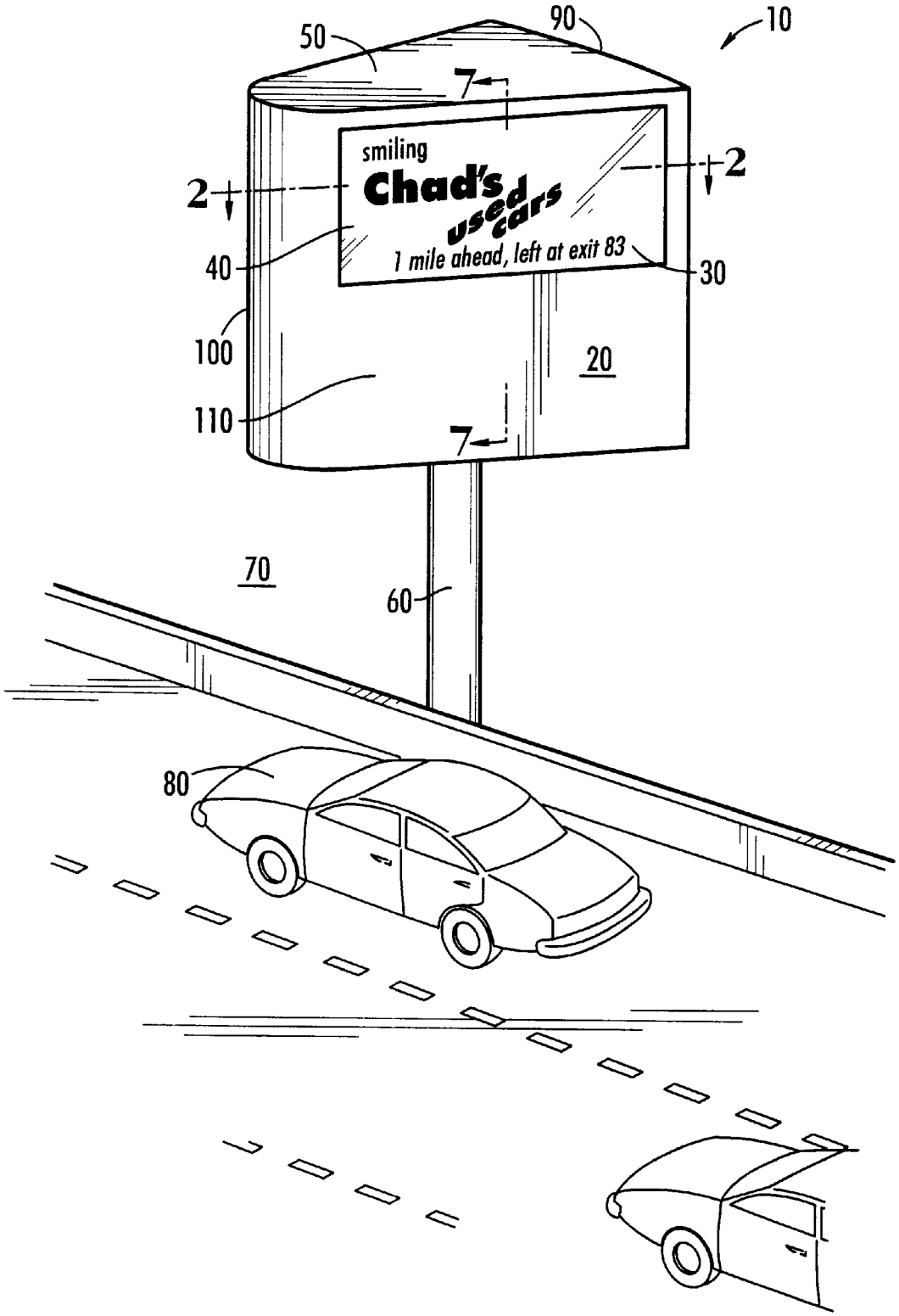
FIG. 1 is a perspective view of a sign apparatus shown in use.

FIG. 1 is a perspective view of a sign apparatus 10 shown in use. The sign apparatus 10 is comprised of a body 20 having an aperture 30 on at least two side walls 110 through which signs 40 are displayed, a top 50, a rear wall 90, a curved front wall 100 and is displayed on a support means 60. In the preferred case the support means 60 is a pole, but any type of conventional support means 60 is acceptable such as rods, fences and boards. It is also possible for the sign apparatus 10 to be attached directly to a support means 60 having a vertical surface such as a wall wherein it is directly bolted or screwed to the vertical support surface. The sign apparatus 10 can also be used by sitting it directly on the ground or a platform and connecting it thereto to keep it in a stationary position. Individual signs 40, which can be used for any purpose such as pictures, advertisements, information and etc., are placed in the aperture 30 so they are visible from the exterior of the body 20. The signs 40 are illuminated from behind, inside the body 20 of the sign apparatus 10, in order to make the information on the signs 40 more visible and easier to read in various types of conditions such as during broad daylight, on overcast, rainy, cloudy days or even in the dark. The illumination of the signs 40 also aids in making the sign apparatus 10 stand out among other structures that may exist in the same area. The sign apparatus 10 can be made in various sizes such as large sizes that are placed along roads 70 so they are visible to people passing by in automobiles 80, and they can be made in smaller sizes for use indoors such as at the end of aisles in grocery stores or at indoor sports arenas. Regardless of the size, the sign apparatus 10 is versatile to be used indoors or outdoors, in high and low locations and in dark or light conditions.

Figure 2:
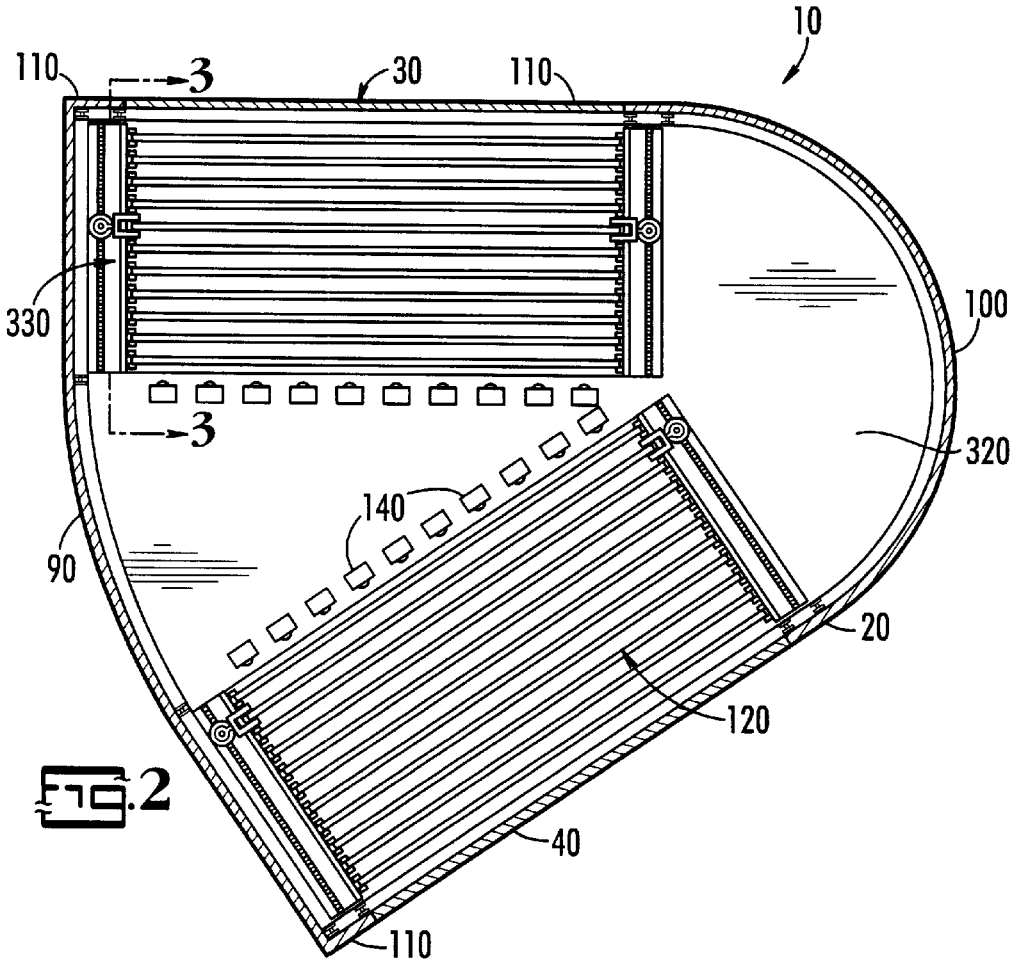
FIG. 2 is a cross-sectional view of a sign apparatus taken along line 2—2 in FIG. 1.

FIG. 2 is a cross-sectional view of the sign apparatus 10. The sign apparatus 10 is modified or loosely triangular in cross-section and has a curved rear wall 90 and a curved front wall 100 with two straight side walls 110 (shown in FIG. 1). Each side wall 110 has an aperture or opening 30 (shown in FIG. 1) therein within which an sign 40 is placed for viewing. The sign 40 can be replaced as desired and is illuminated from inside the sign apparatus 10 thus making the sign 40 easily viewable from outside. Adjacent each side wall 110 within the sign apparatus 10 is a magazine 120 for holding a plurality of cartridges 130, each sign 40 housed within a cartridge 130. Within each magazine 120, a specific cartridge 130 may be selected and advanced to the aperture 30 in the sidewall 110 making the sign 40 visible through the aperture 30 outside the sign apparatus 10.

The body 20 is comprised of a slightly curved rear wall 90 that is connected at each end to a side wall 110. Each side wall 110 is connected at its opposite end to a curved nose or front wall 100 thus forming an enclosed frame that is shaped similar to a modified triangle in cross-section. The body 20 has a roof or top 50 (shown in FIG. 1) as well as a bottom or floor (shown in FIG. 3) which together with all the walls form a complete enclosure. The magazine 120 is located in the lower portion of the body 20 while the apertures 30 are located in the upper portion of each side wall 110. Therefore, as a cartridge 130 is selected, it is raised up above the magazine 120 and moved in place within the aperture 40. This process will be discussed in more detail as follows. Illumination means 140 such as lights are located above and behind the magazine 120. The illumination means 140 are used to illuminate the individual signs 40 within each cartridge 130 so they are more visible from the exterior of the sign apparatus 10. The illumination means 140 are of any conventional type such as lights or lamps, but not limited thereto. There are a plurality of illumination means 140 located in a parallel fashion lengthwise to the magazine 120 in order to completely illuminate the sign 40 within each aperture 30 from behind or within the sign apparatus 10. In the preferred embodiment, a plurality of illumination means 140 are necessary to eliminate any unnecessary shadows or dark places within the sign 40. However, a single illumination means 140 for each magazine or even a single illumination means 140 for the entire sign apparatus 10 may be used if it satisfies the previously stated objectives and provides enough illumination to each sign 40.

Figure 3:
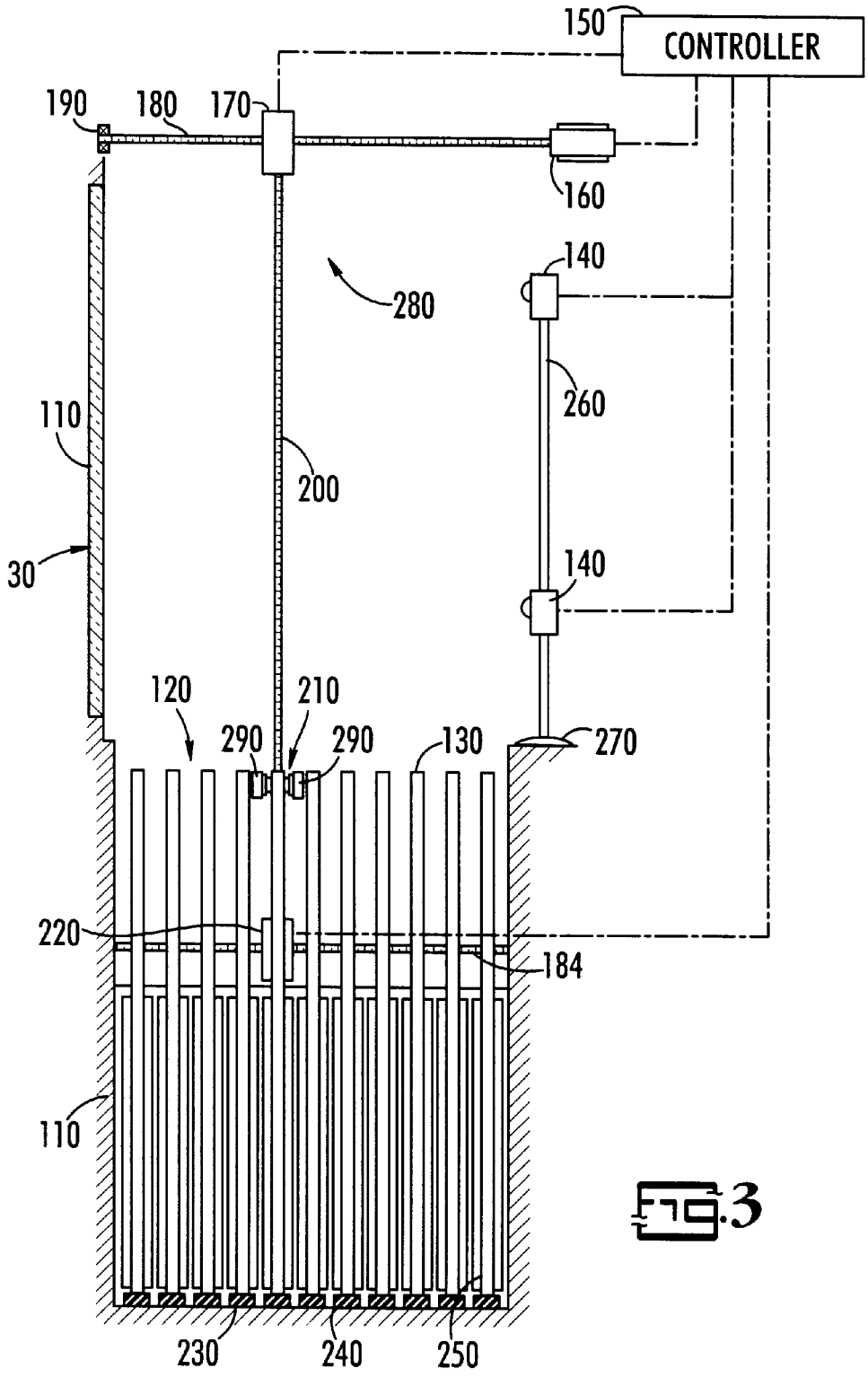
FIG. 3 is a cross-sectional view, taken along line 3—3 in FIG. 2, of a sign apparatus having a sign in a lowered position and being located by a gripper means.
Figure 4:
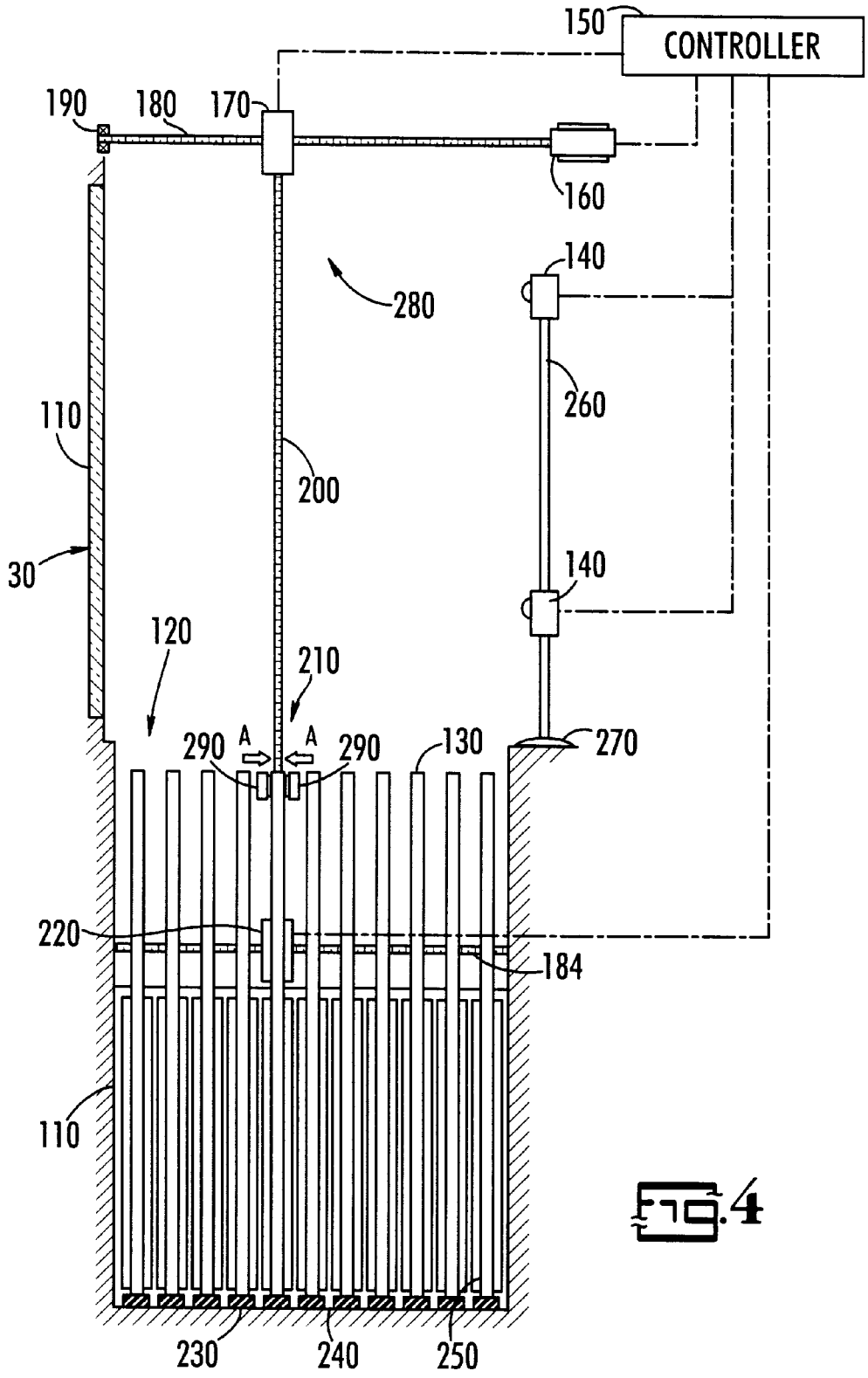
FIG. 4 is a cross-sectional view of a sign apparatus having a sign in a lowered position and the gripper means in place gripping the sign.

FIGS. 3 & 4 are cross-sectional views of the sign apparatus 10 having a sign 40 in a lowered position, being located by a gripper means 210 (FIG. 3) and being gripped by the gripper means 210 (FIG. 4). A plurality of cartridges 130 are stored parallel to one another and on end in the magazine 120. The magazine 120 has numerous channels 250 for holding the cartridges 130 in place. A cartridge 130 is placed in a slot or channel 250 from the top of the slot or channel 250 and lowered until the cartridge 130 comes to rest on springs 230. The springs 230 supports the cartridge 130 so that is does not touch the bottom 240 of the sign apparatus 10 and it helps to maintain the cartridge 130 in an upright position within the slot or channel 250. A central controller 150 controls the movement of an upper winch 170 that retrieves the cartridges 130 from their stored position within the magazine 120. The controller 150 can be an internal computer or can simply be comprised of a series of manual controls. The controller 150 also controls the illumination means 140 by turning them off and on as desired. The illumination means 140 are positioned above the magazine 120 and on the interior of the sign apparatus 10. In the preferred embodiment, there are at least two rows of illumination means 140, one lower row and one upper row. The illumination means 140 are maintained in place by a support 260 which is of any conventional type of support such as a pole, rod, board, etc. Each support 260 is connected and held upright by a support base 270 which is then attached to an interior floor 320 of the body 20. In this embodiment, each support 260 has at least two illumination means 140 attached thereto, but more or less is acceptable depending upon the particular sign apparatus 10 and the desired results. There is a row of supports 260 adjacent to each magazine 120 for illuminating the individual signs 40 as they are retrieved for illustration and display from each magazine 120. Each illumination means 140 is controlled by the controller 150 and can be set manually or automatically. The controller 150 will signal when the illumination means 140 is to be turned on and off. The support bases 270 are attached to the interior floor 320 of the body 20 which is elevated in the middle and front portion of the sign apparatus 10 forming an internal platform 310 with two trough-like areas or channels 330 on two sides within which a magazine 120 is placed. This orientation allows for the magazine 120, full of stored signs 40 to be lower that the internal floor 320. Therefore, the signs 40 are protected when in their stored position within the magazine 120. The platform 310 is of the same configuration as the exterior of the sign apparatus 10, that is the rear wall 90, front wall 100 and side walls 110, somewhat triangular in cross-section, with the exception of the two trough-like areas or channels 330.

The retrieval means 280 is a system used for retrieving each individual cartridge 130 and placing the cartridge 130 in the appropriate location so either the sign 40 is visible through the aperture 30 or stored in the magazine 120. The retrieval means 280 is comprised of a motor 160 which is connected to an upper horizontal track 180 at one end of the upper horizontal track 180. An upper winch 170 is located on the upper horizontal track 180 and moves back and forth, in a horizontal direction, along the entire length of the upper horizontal track 180. The end of the upper horizontal track 180 opposite where the motor 160 is located is attached 10 a side wall 110 with connecting means 190. Attached to the winch 170 at one end and extending vertically down from the winch 170 is a vertical track 200. The vertical track 200 spans or extends the entire distance from the upper horizontal track 180 to a lower horizontal track 184. The lower horizontal track 184 extends from an interior wall 300 to the side wall 110 on the exterior of the sign apparatus 10. A lower winch 220 moves horizontally along the lower horizontal track 184. The side wall 110 and the interior wall 300 form a trough-like area or channel 330 wherein the magazine 120 is stored. At the lower end of the vertical track 200 is a set of gripper means 210. The gripper means 210 has two grips 290, one on each side of the vertical track 200 and are used to grip the cartridges 130 housing the signs 40, raise them and move them to a display position adjacent or within the aperture 30 in the side wall 110.

Figure 5:
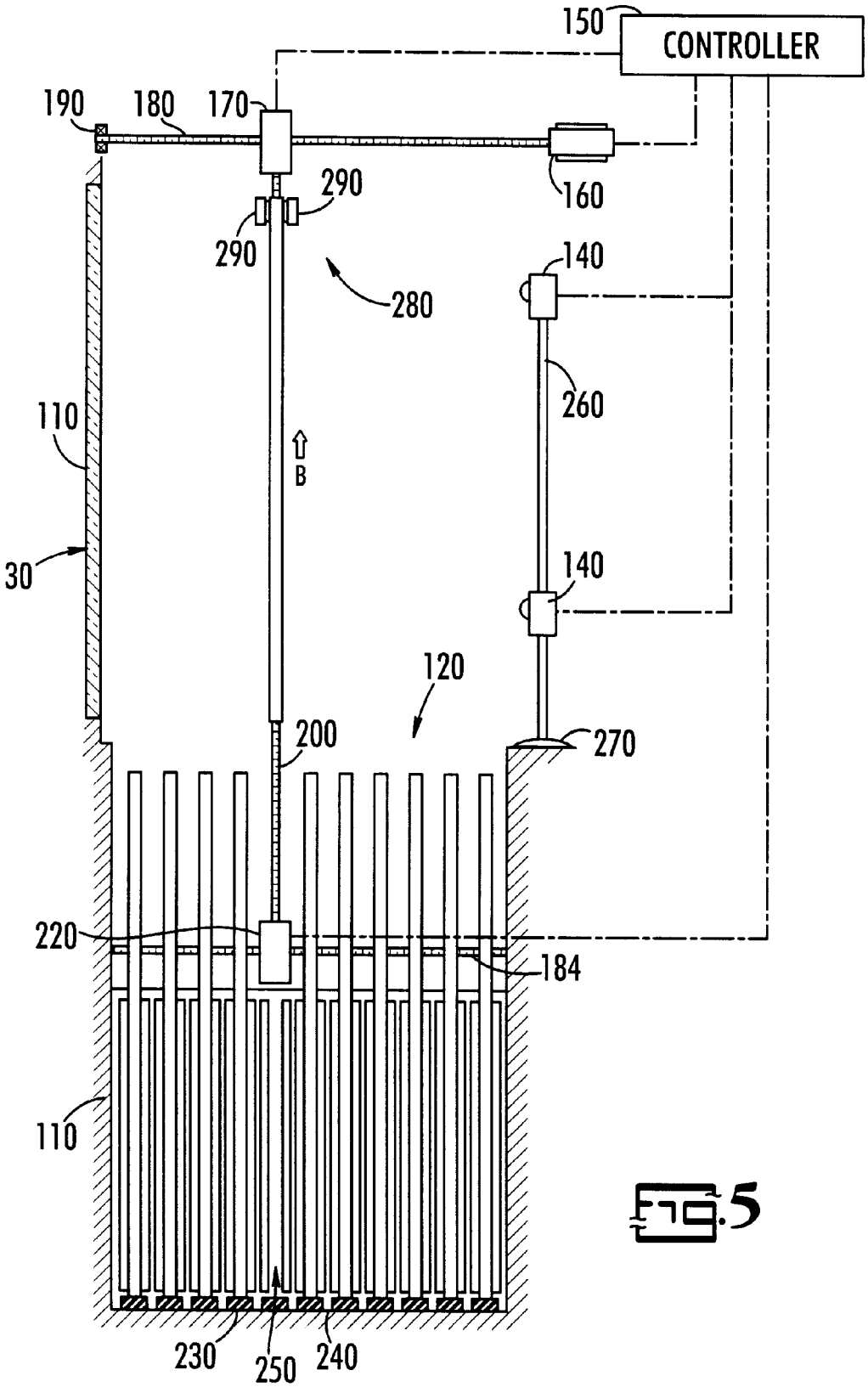
FIG. 5 is a cross-sectional view of a sign apparatus having a sign in a raised, non-display position.

FIG. 5 is a cross-sectional view of the sign apparatus 10 having a sign 40 in a raised, non-display position. After a sign 40 is chosen as the next one to be displayed, a signal is sent to the controller 150 from an inside or outside source. The controller 150 is connected, either physically or through an infrared system, to the retrieval means 280. A signal is sent from the controller 150 to the retrieval means 280 identifying the next sign 40 which is to be displayed and also a signal directing the retrieval means 280 on the process necessary to take to retrieve the sign 40 and position it within or adjacent aperture 30. The controller 150 signals the motor 160, the upper winch 170, the illumination means 140 and the lower winch 220 as to the retrieval of the sign 40 that is to be retrieved from the magazine 120. When the motor 160 and the upper winch 170 receive the signal from the controller 150, the upper winch is moved along the upper horizontal track 180 to the desired position. Simultaneously, the lower winch 220 is moved along the lower horizontal track 184 until the lower winch 220 locates the desired sign 40. Once the sign 40 is located, the upper and lower winches 170, 220 stop moving horizontally across the upper and lower horizontal tracks 180, 184. The gripper means 210 is lowered vertically along the vertical track 200 until in the desired position. The gripper means 210 then activates the grips 290 to grip the desired sign 40 and raise it until it is above the magazine 120 and parallel to the aperture 30 in the side wall 110. The grips 290 are raised along vertical track 200 in the direction of arrow B until the sign 40 is in a position to be moved horizontally into or adjacent the aperture 30 of side wall 110. When fully raised, the sign 40 is then moved horizontally into or adjacent the aperture 30 as discussed with reference to FIGS. 6 & 7.

Figure 6:
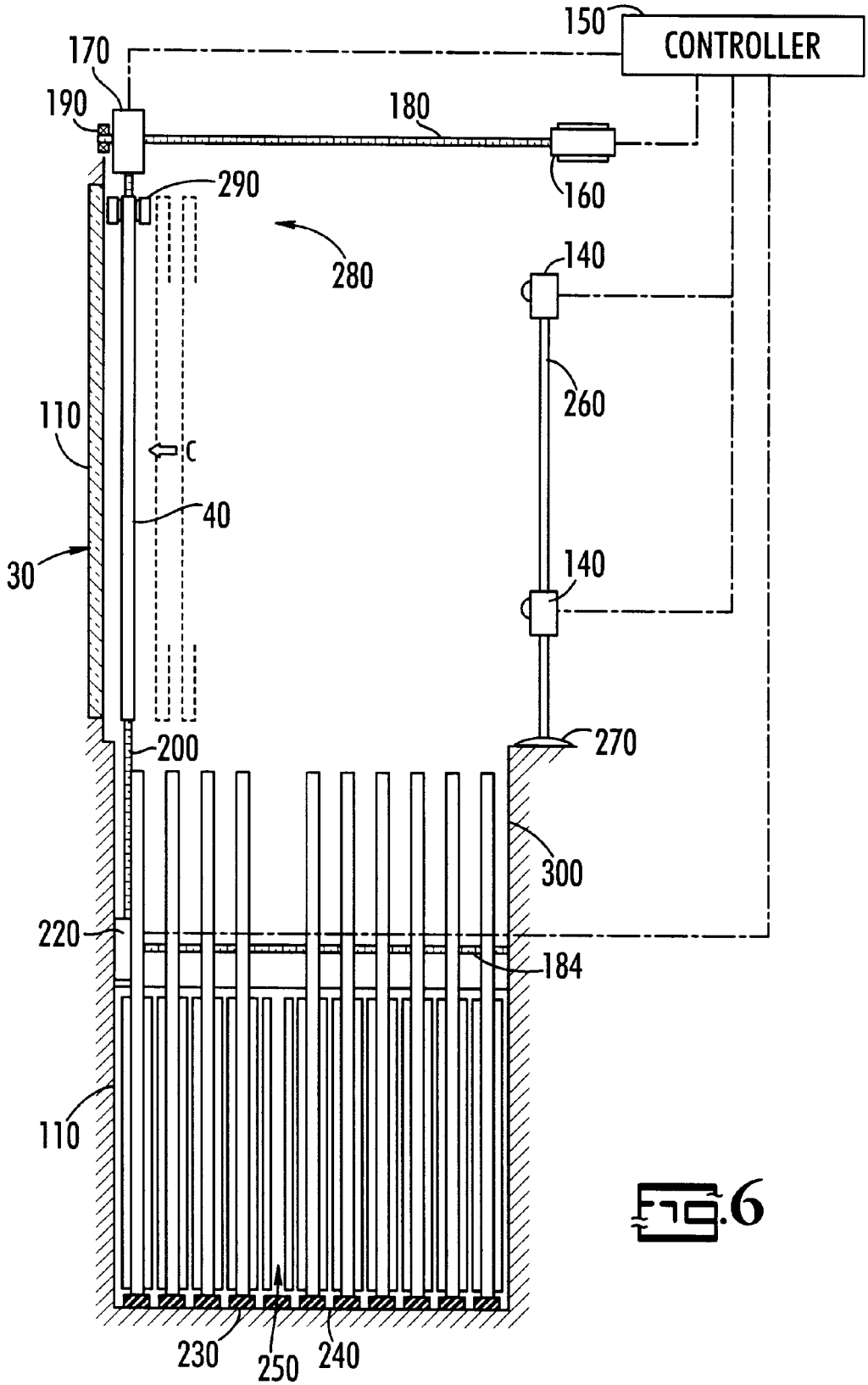
FIG. 6 is a cross-sectional of a sign apparatus having a sign in a raised, display position.
Figure 7:
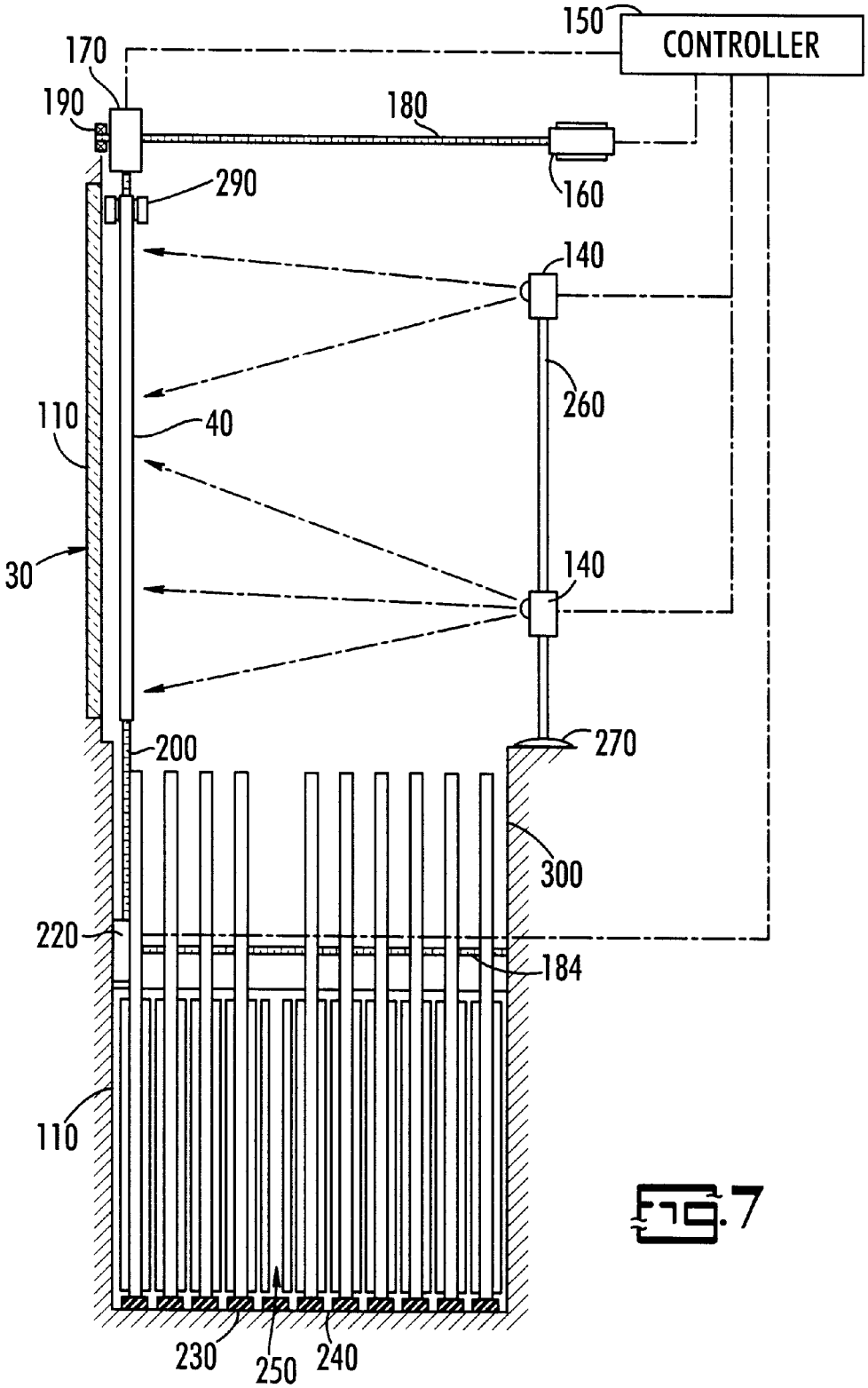
FIG. 7 is a cross-sectional view, taken along line 7—7 in FIG. 1, of a sign apparatus having a sign in a raised, display position and illumination means illuminating the sign.

FIGS. 6 & 7 are cross-sectional views of the sign apparatus 10 in a raised, display position (FIG. 6) and with the illumination means 140 illuminating a sign 40 from within the sign apparatus 10 (FIG. 7). Once the sign 40 is in the raised position above the magazine 120, it is then advanced toward the aperture 30 in the side wall 110. The retrieval means 280 advances the sign 40 in direction of arrow C along the upper and lower horizontal tracks 180, 184 until the sign 40 is positioned directly adjacent the aperture 30 in the side wall 110. The sign 40 is then visible on the exterior of the sign apparatus 10 through the aperture 30. The controller 150 also signals the illumination means 140 to illuminate the sign 40 from within the sign apparatus 10. In the preferred embodiment, the sign 40 is transparent in nature, thus the illumination of it from within the sign apparatus 10 is achieved by the illumination means 140 which illuminates it to the exterior of the sign apparatus making it easy to see and read from various locations around the sign apparatus 10. When the sign 40 is no longer desired for display, it is returned to the magazine 120 by reversing the previously stated process. That is, the sign 40 is transported horizontally away from the aperture 30 back towards the center or middle of the sign apparatus 10 until the sign 40 is aligned above the slot or channel 250 in which it was previously stored. The sign 40 can then be lowered into the slot or channel 250 and placed back in the magazine 120 where it will remain stored until used again or replaced. A different sign is then chosen and the procedure followed once again to place the sign 40 in the aperture 30 of the side wall 110 for viewing. This same process occurs on both sides of the sign apparatus 10 hence ultimately displaying at least two separate signs 40 at the same time. Should the overall shape of the body 20 of the sign apparatus 10 be changed to another common shape such as a rectangular or square, then it may be possible to add more magazines 120 to correspond to the number of side walls 110, for example, with a square shaped body 20 it would be possible to display four separate signs 40 in four apertures 30 on four side walls 110.

The sign apparatus 10 described herein and illustrated in the drawings is subject to other advantages and modifications that may be apparent to those of ordinary skill in the art without departing from the spirit and scope of the appended claims. Accordingly, the invention is to be limited only by the scope of the following claims and their equivalents.

What is claimed is:

1. A sign apparatus, comprising:

a body with at least one aperture for housing said sign apparatus;

at least one sign for displaying in said aperture;

a magazine for storing a plurality of said signs;

a controller;

retrieval means for retrieving said at least one sign and positioning said at least one sign adjacent said aperture;

wherein said controller signals and controls said retrieval means when retrieving said sign for display in said aperture and an upper horizontal track and a lower horizontal track upon which said retrieval means moves;

a power supply located on said upper horizontal track for providing power to said retrieval means;

at least one upper winch for transversing said upper horizontal track;

at least one lower winch for transversing said lower horizontal track; and at least one vertical track extending between said upper and lower track;

wherein said upper and lower winches move simultaneously along said respective upper and lower tracks until they are in alignment with a desired sign that is to be retrieved.

2. The sign apparatus of claim 1, further comprising:

at least one gripper means located on said vertical track for moving a desired sign.

3. The sign apparatus of claim 2, wherein:

said gripper means has at least two grips for gripping said desired sign; and wherein said grips are attached to said sign for moving said sign to a desired location within said sign apparatus.

4. The sign apparatus of claim 3, further comprising:

said gripper means moves at least one of said plurality of stored signs from said magazine to a location adjacent said aperture and back to said magazine.

5. The sign apparatus of claim 4, wherein:

said at least one sign is transparent.

6. The sign apparatus of claim 5, further comprising:

an illumination means capable of illuminating said at least one sign.

7. A sign apparatus composed of:

a body having an aperture for displaying signs;

at least one cartridge;

at least one sign located within said cartridge;

a retrieval means having a plurality of tracks along which said retrieval means moves, at least one upper winch, at least one lower winch, said upper and lower winches capable of traveling along said plurality of tracks, a gripper means having a plurality of grips for gripping said cartridge;

a magazine for storing said cartridge;

an illumination means for illuminating said at least one sign when displayed from behind and therethrough;

a controller for controlling said retrieval means, said gripper means and said illumination means;

wherein said controller sends signals to said retrieval means for retrieving and transporting said at least one sign from said magazine to a position adjacent to said aperture and said controller sends a signal to said illumination for illuminating said sign for display on an exterior of said sign apparatus.

8. A method for displaying a sign, comprising the steps of:

providing a sign apparatus having a body with an aperture for displaying signs, a plurality of cartridges, at least one sign located within each cartridge of said plurality of cartridges, a retrieval means having a plurality of tracks along which said retrieval means moves, at least one upper winch, at least one lower winch, said upper and lower winches capable of traveling along said plurality of tracks, a gripper means having a plurality of grips for gripping said cartridge, a magazine for storing said plurality of cartridges, an illumination means for illuminating said at least one sign when displayed from behind and therethrough, and a controller for controlling said retrieval means, said gripper means and said illumination means, wherein said controller sends signals to said retrieval means for retrieving and transporting said cartridge from said magazine to a position adjacent to said aperture and said controller sends a signal to said illumination means for illuminating said sign for display on an exterior of said sign apparatus;

selecting at least one cartridge from said plurality of cartridges;

controlling said retrieval means with a controller;

retrieving said at least one cartridge from said magazine;

moving said at least one cartridge from said magazine to a display position;

positioning said at least one cartridge adjacent said aperture for display;

illuminating said at least one sign within said at least one cartridge with said illumination means;

returning said cartridge to said magazine with said retrieval means;

wherein said steps of selecting, controlling, retrieving, moving, positioning, illuminating and returning form a method of displaying a sign.

* * * * *